US007895788B1

(12) United States Patent
Cilia et al.

(10) Patent No.: US 7,895,788 B1
(45) Date of Patent: Mar. 1, 2011

(54) BALLISTIC TIRE-DEFLATION DEVICE FOR SECURITY VEHICLES

(75) Inventors: Andrew Cilia, McKinney, TX (US); Robert V. Vanman, McKinney, TX (US)

(73) Assignee: Enforcement Video, LLC, Plano, TX (US)

( * ) Notice: Subject to any disclaimer, the term of this patent is extended or adjusted under 35 U.S.C. 154(b) by 157 days.

(21) Appl. No.: 12/181,571

(22) Filed: Jul. 29, 2008

Related U.S. Application Data

(60) Provisional application No. 60/953,723, filed on Aug. 3, 2007.

(51) Int. Cl.
*F41C 27/00* (2006.01)
*F41F 1/08* (2006.01)

(52) U.S. Cl. ..... 42/106; 89/1.41; 89/127

(58) Field of Classification Search ..... 42/106; 89/1.41, 126, 127
See application file for complete search history.

(56) References Cited

U.S. PATENT DOCUMENTS

| | | | | | |
|---|---|---|---|---|---|
| 1,191,380 | A * | 7/1916 | Zumwalt | 89/40.03 |
| 1,603,097 | A * | 10/1926 | Wright | 89/1.41 |
| 2,097,962 | A * | 11/1937 | Boussel | 89/127 |
| 2,355,179 | A * | 8/1944 | Pontius, III | 89/1.4 |
| 2,406,102 | A * | 8/1946 | Pontius, III et al. | 89/127 |
| 2,971,440 | A * | 2/1961 | O'Brien | 89/126 |
| 3,208,350 | A * | 9/1965 | Robinson | 89/34 |
| 4,019,422 | A * | 4/1977 | Magnuson | 89/1.815 |
| 5,299,487 | A * | 4/1994 | Bertiller et al. | 89/33.14 |
| 5,381,721 | A * | 1/1995 | Holmstrom et al. | 89/1.51 |
| 7,119,832 | B2 | 10/2006 | Blanco et al. | |
| 7,202,809 | B1 * | 4/2007 | Schade et al. | 342/67 |
| 2001/0015126 | A1 * | 8/2001 | Grunewald | 89/1.41 |
| 2006/0277812 | A1 * | 12/2006 | Cole | 42/96 |

* cited by examiner

*Primary Examiner* — Bret Hayes
(74) *Attorney, Agent, or Firm* — Winstead PC

(57) ABSTRACT

A ballistic vehicle-immobilization apparatus includes an optical module adapted to provide visual feedback to a user to aim at an object. The ballistic vehicle-immobilization apparatus further includes a firing mechanism adapted to fire a projectile towards the object and a housing containing the firing mechanism. The ballistic vehicle-immobilization apparatus is adapted to be mounted to a vehicle.

29 Claims, 4 Drawing Sheets

BALLISTIC TIRE-DEFLATION DEVICE FOR SECURITY VEHICLES

RELATED APPLICATIONS

This patent application claims priority from, and incorporates by reference the entire disclosure of U.S. Provisional Patent Application No. 60/953,723, filed on Aug. 3, 2007.

TECHNICAL FIELD

This patent application relates generally to security vehicles and, in particular, to immobilizing a vehicle fleeing a law-enforcement vehicle.

BACKGROUND

From time-to-time, it becomes necessary for law-enforcement officers to stop a vehicle for the purpose of inspecting the vehicle and/or investigating a vehicle operator. Once the investigation has been completed without incident, the vehicle and its operator are allowed to drive away from the scene of the stop. However, on certain occasions, a suspect wishing to avoid capture or the inspection of his vehicle may flee the scene of the stop prior to completion of the investigation. In such cases, the fleeing vehicle is pursued, typically at high speeds, by one or more law enforcement vehicles until the suspect is caught. As a consequence of the high-speed chase, often covering long distances, the law enforcement officers, innocent motorists traveling on roadways, and even the suspect are susceptible to a risk of injury to themselves and their property.

To prevent a fleeing suspect and his vehicle from escaping, vehicle immobilizers are often utilized. Such vehicle immobilizers are typically spike strips which include a set of spikes to be placed across a roadway and aimed at and adapted to puncture a tire of an oncoming vehicle. A typical vehicle immobilizer includes a set of spikes positioned to engage one or more tires of the vehicle. There is nothing to prevent the vehicle from fleeing in an opposite direction in an effort to completely avoid driving over the spikes and damaging the tires. Moreover, the vehicle immobilizer as described above is fairly large and bulky so as to be inconvenient to transport and difficult to store in a small space, such as in a trunk of the law enforcement vehicle prior to deployment. In this same regard, when not in use, the sharp spikes associated with the vehicle immobilizer may accidentally damage government property or injure individuals in charge of handling the device.

SUMMARY OF THE INVENTION

A ballistic vehicle-immobilization apparatus includes an optical module adapted to provide visual feedback to a user to aim at an object. The ballistic vehicle-immobilization apparatus includes a firing mechanism adapted to fire a projectile towards the object. The ballistic vehicle-immobilization apparatus further includes a housing containing the firing mechanism. The ballistic vehicle-immobilization apparatus is adapted to be mounted to a vehicle.

A ballistic vehicle-immobilization apparatus includes a range-detector module adapted to project laser light towards an object. The ballistic vehicle-immobilization apparatus further includes a firing mechanism adapted to fire a projectile towards the object. The ballistic vehicle-immobilization apparatus is mounted to a front portion of a vehicle and is operable to activate the firing mechanism responsive to the laser light being located on the object.

A ballistic vehicle-immobilization apparatus includes a firing mechanism adapted to fire a projectile towards an object. The ballistic vehicle-immobilization apparatus further includes a housing containing the firing mechanism and is adapted to be mounted to a vehicle. The ballistic vehicle-immobilization apparatus further includes a sighting mechanism including a mechanical sight, an optical sight, and a tracer bullet.

BRIEF DESCRIPTION OF THE DRAWINGS

A more complete understanding of various embodiments of the present invention may be obtained by reference to the following Detailed Description when taken in conjunction with the accompanying Drawings wherein.

DETAILED DESCRIPTION OF ILLUSTRATIVE EMBODIMENTS OF THE INVENTION

Various embodiments of the present invention will now be described more fully with reference to the accompanying drawings. The invention may, however, be embodied in many different forms and should not be construed as limited to the embodiments set forth herein; rather, the embodiments are provided so that this disclosure will be thorough and complete, and will fully convey the scope of the invention to those skilled in the art. The above summary of the invention is not intended to represent each embodiment or every aspect of the present invention.

Figure 1A:
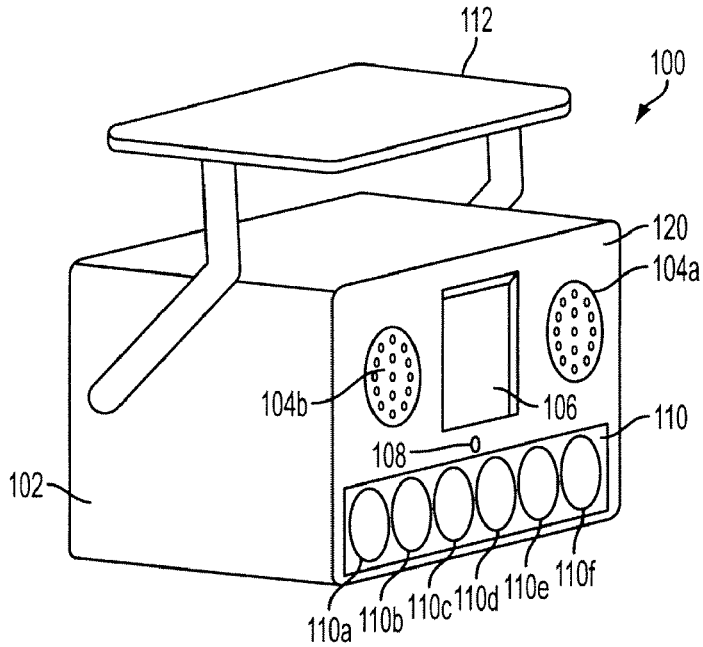
FIG. 1A illustrates a ballistic vehicle-immobilization system.

FIG. 1A illustrates a ballistic vehicle-immobilization system 100. The ballistic vehicle-immobilization system 100 includes a housing 102 having a front surface 120. The ballistic vehicle-immobilization system 100 includes a plurality of radiation modules 104*a* and 104*b*. In a typical embodiment, the plurality of radiation modules 104*a*-104*b* may be, for example, infrared (IR) illuminators. The radiation modules 104*a*-104*b* are adapted, for example, to project infrared (IR) radiation towards an object. In a typical embodiment, the object may be, for example, a tire of a vehicle to be immobilized. The ballistic vehicle-immobilization system 100 further includes an optical module 106. In a typical embodiment, the optical module 106 may be, for example, an infrared camera.

The ballistic vehicle-immobilization system 100 further includes a range-detector module 108. In a typical embodiment, the range-detector module 108 may include, for example, a laser symbol projector. A typical embodiment of the range-detector module 108 is adapted, for example, to project laser light in different shapes such as, for example, dots, lines, cross-lines, and the like. In addition, in some embodiments, the range-detector module 108 may be used alone or in conjunction with the optical module 106 to determine a range to the object.

The ballistic vehicle-immobilization system 100 further includes a firing mechanism 110. In a typical embodiment, the firing mechanism 110 also includes, for example, a plurality of projectile barrels 110*a*-110*f*. The firing mechanism 110 further includes components (not explicitly shown) which operate together in order to discharge at least one of the plurality of projectile barrels 110*a*-110*f*. In a typical embodiment, the components of the firing mechanism may include, for example, a trigger, a firing pin, or the like. The ballistic vehicle-immobilization system 100 also includes a cover 112 adapted to protect against inadvertent firing of a projectile. In a typical embodiment, the plurality of radiation modules 104*a*-104*b*, the optical module 106, the range-detector module 108, and the firing mechanism 110 are housed within the housing 102 as shown in FIG. 1A; however, in other embodiments, the plurality of radiation modules 104*a*-104*b*, the optical module 106, and the range-detector module 108 may be housed separate from the firing mechanism 110 housed within the housing 102.

In the embodiment illustrated in FIG. 1A, the plurality of projectile barrels 110*a*-110*f* are 12-gauge shotgun-shell barrels. In other embodiments, any other number of projectile barrels or other gauges may be utilized as needed. The arrangement of the plurality of radiation modules 104*a*-104*b*, the optical module 106, the range-detector module 108, and the plurality of projectile barrels 110*a*-110*f* as illustrated in FIG. 1A is shown for illustrative purposes. In other embodiments, the plurality of radiation modules 104*a*-104*b*, the optical module 106, the range-detector module 108, and the plurality of projectile barrels 110*a*-110*f* may be utilized in a different arrangement from the one illustrated in FIG. 1A.

The ballistic vehicle-immobilization system 100 may be used to fire, for example, shotgun blasts, solid darts, hollow darts, multi-pellet ammunition, reloadable ammunition cartridges, handguns, repeating firing mechanism such as, for example, automatic or semi-automatic handguns or other firearms to fire the projectiles from the plurality of projectile barrels 110*a*-110*f* of the firing mechanism 110. The projectiles fired from the plurality of projectile barrels 110*a*-110*f* may thus be used, for example, to immobilize a vehicle fleeing a law-enforcement vehicle. In a typical embodiment, the radiation modules 104*a*-104*b* may be employed to project infrared radiation sufficient to permit the optical module 106 to distinguish a tire or other object to be fired upon by the ballistic vehicle-immobilization system 100.

In various embodiments, the ballistic vehicle-immobilization system 100 may be used for targeting. The range-detector module 108 may be adapted to project light in different shapes such as, for example, dots, lines, cross-lines or other images used for range-finding by or aiming of the ballistic vehicle-immobilization system 100 prior to firing of projectiles from the plurality of projectile barrels 110*a*-110*f*. In a typical embodiment, the range-detector module 108 may be operated in one or more of three modes of operation. In a first mode of operation, the range-detector module 108 operates as a range finder. In the first mode of operation, the range-detector module 108 ensures that the ballistic vehicle-immobilization system 100 is within an appropriate range to the object to be fired upon. In a second mode of operation, the range-detector module 108 operates as an aiming mechanism. In the second mode of operation, the range-detector module 108 is be adapted to project light in different shapes such as, for example, dots, lines, cross-lines or other images towards the object for aiming of the ballistic vehicle-immobilization system 100 prior to firing of projectiles from the plurality of projectile barrels 110*a*-110*f*. In a third mode of operation, the range-detector module 108 operates as both a range finder and an aiming mechanism. In a typical embodiment, the range-detector module 108 includes, for example, a laser device such as, for example, the laser symbol projector; however, those having skill in the art will appreciate that other types of devices may be used for purposes of range-finding by or aiming of the ballistic vehicle-immobilization system 100, such as, for example, ultrasonic devices or radar.

Figure 1B:
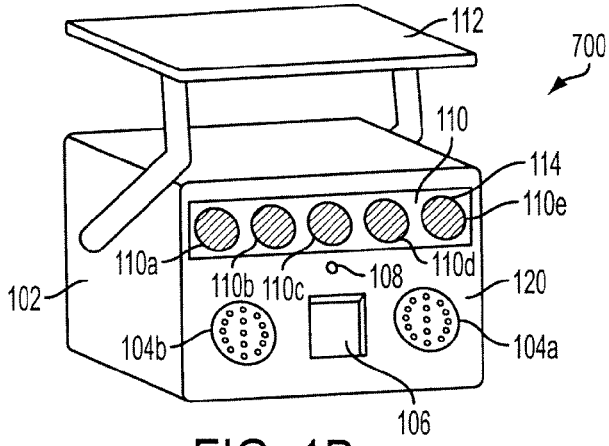
FIG. 1B illustrates a ballistic vehicle-immobilization system.

FIG. 1B illustrates another embodiment of a ballistic vehicle-immobilization system. The ballistic vehicle-immobilization system 700 illustrated in FIG. 1B is similar to the system 100 of FIG. 1A; however, the system 700 of FIG. 1B includes five 12-gauge shotgun-shell barrels (i.e., the projectile barrels 110*a*-110*e*). In a typical embodiment, the plurality of projectile barrels 110*a*-110*e* of the firing mechanism 110 may be mounted behind a sacrificial weather shield 114. The sacrificial weather shield 114 typically includes a water-proof membrane adapted to prevent the plurality of projectile barrels 110*a*-110*f* from water, dust and other debris. The sacrificial weather shield 114 may be made for example of, rubber or canvas and may be destroyed when the projectiles are fired from one or more of the plurality of projectile barrels 110*a*-110*f*.

Figure 1C:
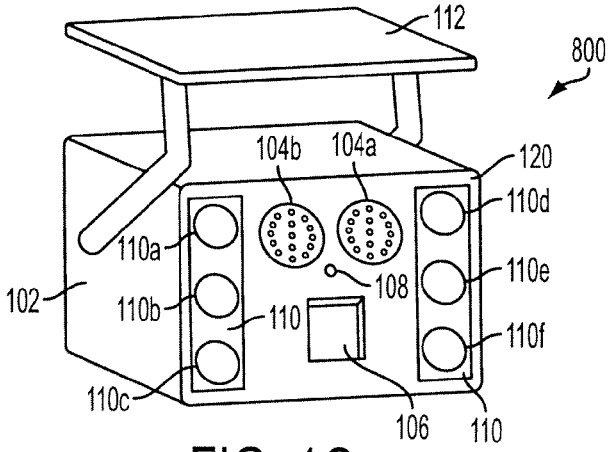
FIG. 1C illustrates a ballistic vehicle-immobilization system.

FIG. 1C illustrates another embodiment of a ballistic vehicle-immobilization system. The ballistic vehicle-immobilization system 800 shown in FIG. 1C is similar to the system 100 of FIG. 1A; however, the system 800 of FIG. 1C includes the plurality of radiation modules 104*a*-104*b*, the optical module 106, the range-detector module 108, and the plurality of projectile barrels 110*a*-110*f* of the firing mechanism 110 housed within the housing 102 in a different arrangement from the arrangement illustrated in FIG. 1A.

Figure 1D:
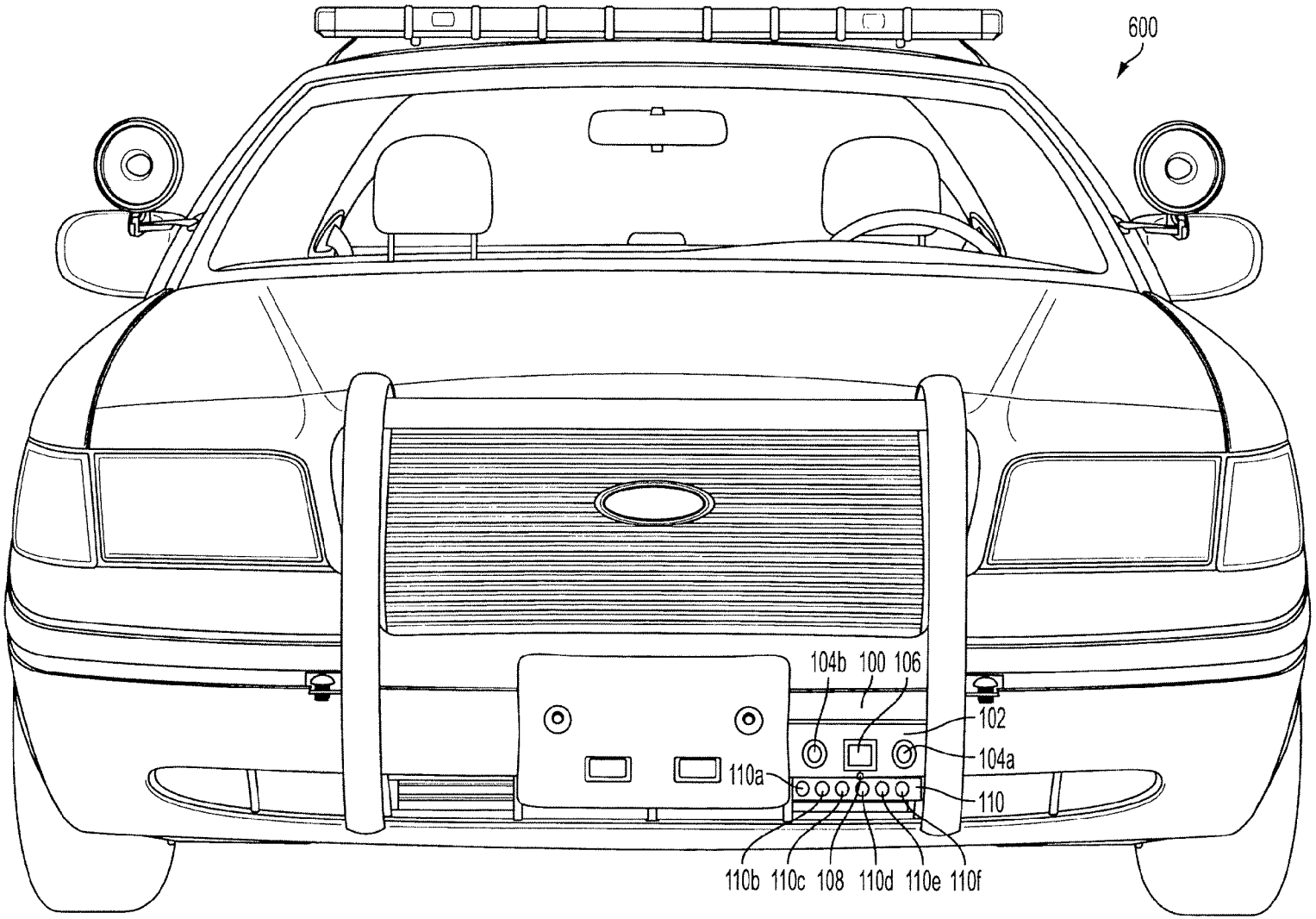
FIG. 1D illustrates a ballistic vehicle-immobilization system positioned on a vehicle.

FIG. 1D illustrates the ballistic vehicle-immobilization system 100 positioned at various locations on a law-enforcement vehicle 600. The ballistic vehicle-immobilization system 100 may be, in a typical embodiment, mounted to a front portion of the law-enforcement vehicle 600 such as, for example, a front bumper adjacent a license plate of the law-enforcement vehicle 600 towards the driver's side. In a typical embodiment, the ballistic vehicle-immobilization system 100 may be mounted at a height such that the plurality of projectile barrels 110*a*-110*f* level with at least one tire of a vehicle to be immobilized and is positioned directly straight ahead of the vehicle to be immobilized. Although, in a typical embodiment, the ballistic vehicle-mobilization system 100 may be mounted to the front portion of the law enforcement patrol car 600, the ballistic vehicle-immobilization system 100 need not necessarily be thusly mounted. Rather, the ballistic vehicle-immobilization system 100 may be mounted to one or more of a side, rear, or any other portion of the law-enforcement vehicle 600. The ballistic vehicle-immobilization system 100 as illustrated in FIG. 1D is shown for illustrative purposes. In other embodiments, the ballistic vehicle-immobilization systems 600, 700 may also be positioned at various locations on the law-enforcement vehicle 600.

Figure 2A:
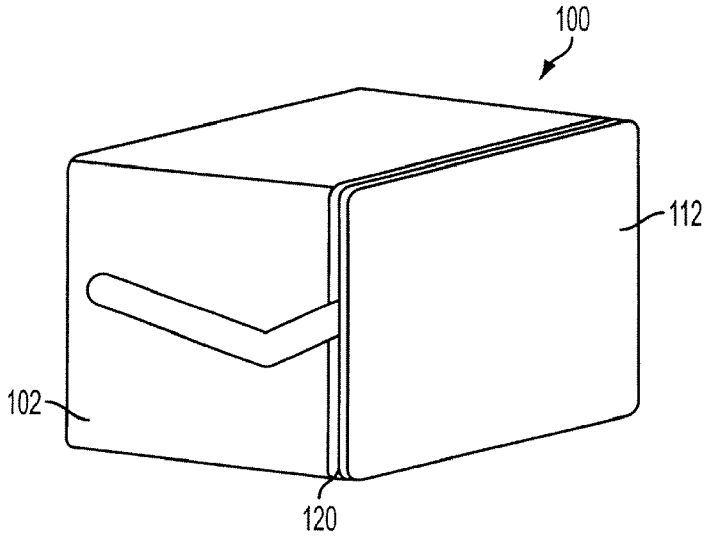
FIG. 2A illustrates a ballistic vehicle-immobilization system covered by a cover.
Figure 2B:
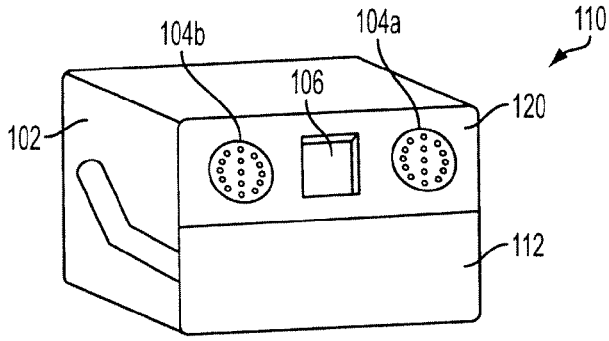
FIG. 2B illustrates a ballistic vehicle-immobilization system covered by a cover.

FIGS. 2A-2B illustrate the ballistic vehicle-immobilization system 100 covered by the cover 112. In a typical embodiment, the cover 112 is adapted to be rotated and positioned to protect against inadvertent firing of the plurality of projectile barrels 110*a*-110*f* and to protect the infrared illuminators 104*a* and 104*b*, the optical module 106, the range-detector module 108, and the plurality of projectile barrels 110*a*-110*f* of the firing mechanism 110 from weather or road debris. In other embodiments, the cover 112 is adapted to be slid into and positioned to protect against inadvertent firing of the plurality of projectile barrels 110*a*-110*f* and to protect the infrared illuminators 104*a* and 104*b*, the optical module 106, the range-detector module 108, and the plurality of projectile barrels 110*a*-110*f* of the firing mechanism 110 from weather or road debris. In other embodiments, the cover 112 comprises a hinge adapted to position the cover 112 to protect against inadvertent firing of the plurality of projectile barrels 110*a*-110*f* and to protect the infrared illuminators 104*a* and 104*b*, the optical module 106, the range-detector module 108, and the plurality of projectile barrels 110*a*-110*f* of the firing mechanism 110 from weather or road debris. Although the cover 112 as illustrated in FIG. 2A covers substantially the entire front surface 120 of the ballistic vehicle-immobilization system 100, those having skill in the art will appreciate that the cover 112 may be dimensioned differently to cover, for example, only the plurality of projectile barrels 110*a*-110*f* as shown in FIG. 2B. In a typical embodiment, the cover 112 may be, for example, a unitary cover that may be weather-proof, wind-proof and may be made of, for example, plastic, metal, or any other relatively hard resilient material. In other embodiments, the cover 112 may be sacrificial and made for example of, rubber or canvas and may be destroyed when the projectiles are fired from one or more of the plurality of projectile barrels 110*a*-110*f*.

In a typical embodiment, one or more of three ballistic vehicle-immobilization system modes of operation may be used: (1) a manual mode; (2) an assisted mode; and (3) an automatic mode. In the manual mode of operation, the laser light output from the range-detector module 108 indicates where the ballistic vehicle-immobilization system is aimed. In the manual mode, it is up to the user to line up his or her vehicle until, for example, a red line or dot is located on a tire or other object to be fired upon and to then manually fire the ballistic vehicle-immobilization system. In the manual mode, the optical module 106 may be used to provide visual feedback to the user; however, use of the optical module 106 is optional if the user can see the laser output without assistance from the optical module 106. In a typical embodiment, the optical module 106 is an infrared camera, it will be apparent to those having skill in the art that a visible-spectrum camera may be used instead of or in addition to the infrared camera 106. Those having skill in the art will also appreciate that the manual mode of operation is not necessarily dependent upon use of the range-detector module 108 and that other sighting or range-finding systems may be utilized such as, for example, mechanical or optical sights, tracer bullets, and the like. Further to the above, those having skill in the art will appreciate that, in bright sunlight, it might be difficult to see a dot, line, or other image produced by the range-detector module 108 with the naked eye. In such cases, the user may use an image from the optical module 106 to assist in aiming the ballistic vehicle-immobilization system.

In the assisted mode, the ballistic vehicle-immobilization system employs automatic target detection and tracking ("ATDT") algorithms to locate a tire or other object to be fired upon and, in a typical embodiment, provides, for example, auditory feedback to the user, for example, in the form of tones, beeps, or a synthetic voice. In the assisted mode, when the ballistic vehicle-immobilization system is properly aimed at a tire or other object to be fired upon, a distinctive tone, voice, or other notification may be used to alert the user that proper aiming has been achieved. In response, the user may then give a command to the ballistic vehicle-immobilization system to fire on the object. The ballistic vehicle-immobilization system then automatically fires on the object.

In the automatic mode, the ballistic vehicle-immobilization system employs ATDT to locate a tire or other object to be fired upon. Once the object to be fired upon has been located by the ballistic vehicle-immobilization system, the ballistic vehicle-immobilization system prompts the user for permission to fire. Once permission has been granted by the user, the ballistic vehicle-immobilization system guides the user to the target using, for example, auditory or other feedback as used in the assisted mode described above. When the object to be fired upon is in range and has been properly targeted at by the ballistic vehicle-immobilization system (e.g., is in the so-called kill zone), the ballistic vehicle-immobilization system automatically fires upon the object.

Figure 3:
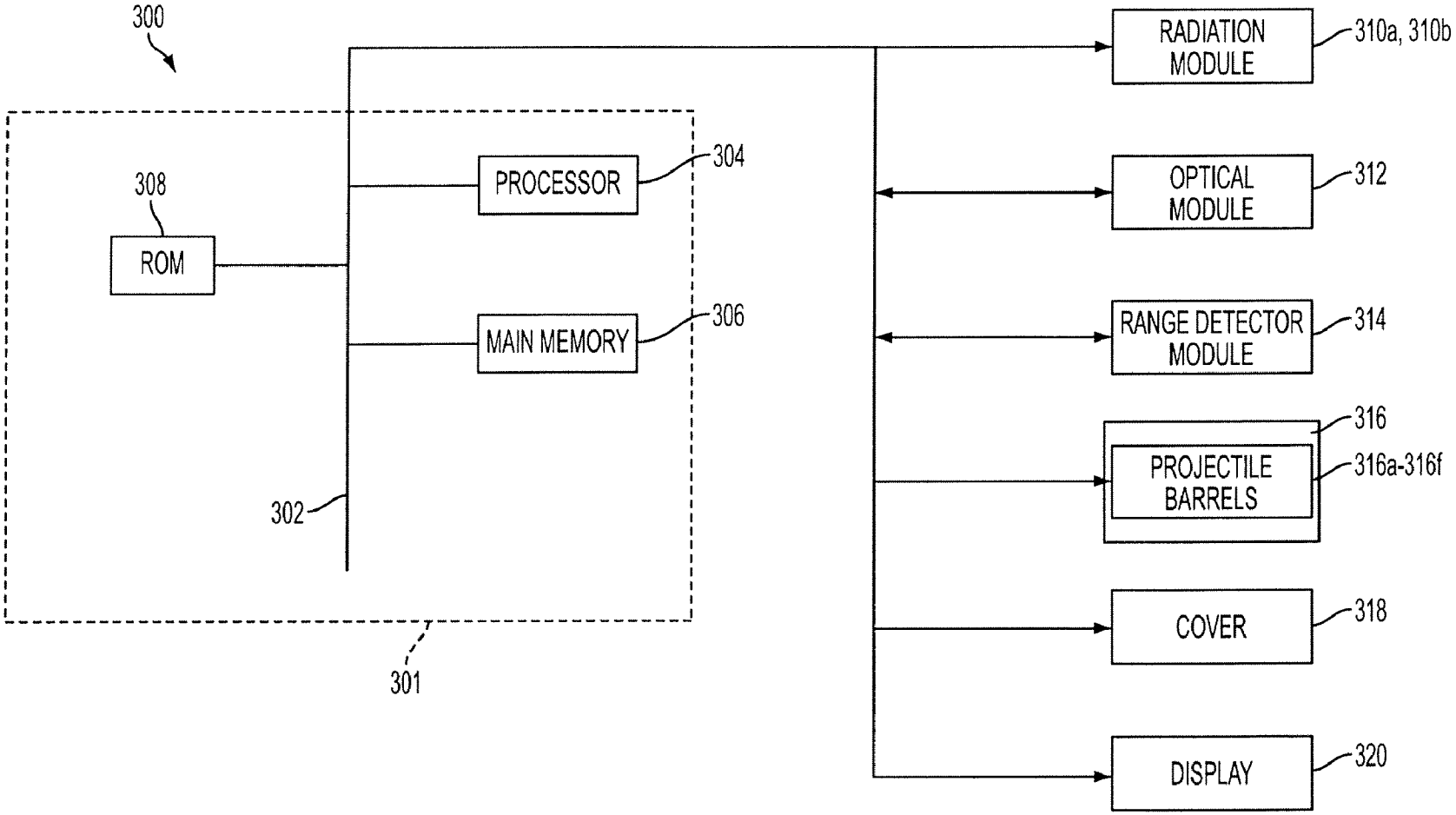
FIG. 3 illustrates a system diagram for implementing a ballistic vehicle-immobilization system.

FIG. 3 illustrates a system 300 on which various embodiments of the ballistic vehicle-immobilization system may be implemented. The system 300 includes a control computer 301. The control computer 301 includes a bus 302 or other communication mechanism for communicating information. The system 300 further includes a processor 304 coupled to the bus 302 for processing information. The control computer 301 further includes a main memory 306 such as, for example, a random access memory (RAM) or other dynamic storage device, coupled to the bus 302.

The control computer 301 further includes a read only memory (ROM) or other storage device connected to the bus 302 for storing static information and instructions from the processor 302. The control computer 301 may be coupled via the bus 302 to at least one radiation module 310*a*, 310*b* and an optical module 312. In a typical embodiment, the at least one radiation module 310*a*, 310 may be, for example, an infrared (IR) illuminator while the optical module 312 may be, for example, an infrared camera. The control computer 301 may further be coupled to a range-detector module 314, a firing mechanism 316 including a plurality of projectile barrels 316*a*-316*f*, a cover 318, and a display 320. In a typical embodiment, the display 320 may be, for example, a liquid crystal display (LCD) adapted to provide visual feedback to a user. The display 320 may further be adapted to visually configure the ATDT algorithm.

In a typical embodiment, the bus 302 is adapted to communicate information between the control computer 301 and one or more components of the ballistic vehicle-immobilization system such as, for example, the at least one radiation module 310*a*-310*b*, the optical module 312, the range-detector module 314, the plurality of projectile barrels 316*a*-316*f*, the cover 318, and the display 320.

Those having skill in the art will appreciate that various embodiments of the ballistic vehicle-immobilization system may be designed to fire all, one, or more than one but fewer than all of the projectiles of the plurality of projectile barrels 110*a*-110*f* in response to predetermined conditions having been met. For example, the ballistic vehicle-immobilization system may select a single best projectile of the plurality of projectile barrels 110*a*-110*f* to fire in order to increase the likelihood of a direct strike on a tire or other object to be fired upon. In other embodiments, more than one projectile may be fired simultaneously or in some predetermined sequence.

In various embodiments, safety features are implemented in the ballistic vehicle-immobilization system to decrease the risk of inadvertent firing or damage to objects other than those intended to be fired upon using the ballistic vehicle-immobilization system. For example, the ballistic vehicle-immobilization system may be designed to automatically disarm itself if any of the following events were to occur: (1) the ATDT algorithms lose track of the targeted object; (2) the law-enforcement vehicle slows down to less than a minimum speed threshold such as, for example 10 miles per hour or the law-enforcement vehicle exceeds a maximum speed threshold such as, for example 80 miles per hour; (3) a timeout elapses such as, for example, 10-20 seconds; (4) other vehicles are detected in or nearby the kill zone; (5) the user disarms the ballistic vehicle-immobilization system; or (6) a projectile has been fired within a predetermined time period such as, for example, one minute.

Another safety feature in various embodiments of the ballistic vehicle-immobilization system includes a continuous tone that notifies the user of the targeting status of the ballistic vehicle-immobilization system. In these embodiments, the tone may be changed in pitch as the ballistic vehicle-immobilization system readies to fire.

In a typical embodiment, frangible ammunition may be used to prevent ricochet or ammunition penetration into unwanted areas. Frangible ammunition is designed so that, when the ammunition hits a first surface, the ammunition delivers all the energy to that surface, but then breaks it into powder and does not ricochet. Frangible ammunition is typically used for safety purposes. For example, if the frangible ammunition perforates a tire and then strikes the on which the tire is mounted, the frangible ammunition would not ricochet and strike any other objects. In addition, in some embodiments, the ballistic projectile barrels 110*a*-110*f* may be tilted slightly downward relative to level so that frangible pellets from shotgun shells used in the ballistic projectile barrels 110*a*-110*f* will strike the ground, for example, no further than 25 feet in front of the patrol car. In some embodiments, different types of ammunition may be loaded in different barrels of the ballistic projectile barrels 110*a*-110*f* Ammunition selection may be done, for example, in an automatic fashion based upon range and tire size. Chosen ammunition can vary based upon caliber and number of pellets as well as single bullet (e.g., small arm frangible, etc.).

In other embodiments, a tubular dart for air deflation of a tire may be utilized rather than shotgun shells. In addition, the plurality of projectile barrels 110*a*-110*f* may all be pointed directly forward or may be splayed in order to increase the potential lateral range of the six ballistic projectile barrels 110*a*-110*f*.

Moreover, the cover 112 may be utilized to protect from inadvertent firings of projectiles via the ballistic projectile barrels 110*a*-110*f*. In a typical embodiment, the cover 112 is made of steel or some other hardened material and is rotated or slided away from the plurality of projectile barrels 110*a*-110*f* responsive to arming of the ballistic vehicle-immobilization system.

Although various embodiments of the method and system of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

What is claimed is:

1. A ballistic vehicle-immobilization apparatus comprising:

an optical module adapted to provide visual feedback to a user to aim at an object;

a firing mechanism adapted to fire a projectile towards the object;

a control computer comprising:

a communication mechanism;

a processor; and a memory;

wherein the communication mechanism is operable to communicate information between the control computer and the ballistic vehicle-immobilization apparatus;

wherein, responsive to the speed of a vehicle falling below a pre-determined threshold speed, the control computer communicates information to the firing mechanism that causes the ballistic vehicle-immobilization apparatus to disarm; and wherein the ballistic vehicle-immobilization apparatus is mounted to the vehicle.

2. The ballistic vehicle-immobilization apparatus of claim 1, wherein the firing mechanism comprises a plurality of projectile barrels.

3. The ballistic vehicle-immobilization apparatus of claim 2, wherein at least one of the plurality of projectile barrels is fired singularly.

4. The ballistic vehicle-immobilization apparatus of claim 2, wherein the plurality of projectile barrels are fired simultaneously.

5. The ballistic vehicle-immobilization apparatus of claim 2, wherein the plurality of projectile barrels are mounted behind a sacrificial cover; and the sacrificial cover prevents foreign objects from entering the plurality of projectile barrels.

6. The ballistic vehicle-immobilization apparatus of claim 1, wherein the ballistic vehicle-immobilization apparatus further comprises:

at least one radiation module adapted to project infrared (IR) radiation towards the object; and a range-detector module adapted to project laser light towards the object.

7. The ballistic vehicle-immobilization apparatus of claim 6, wherein the at least one radiation module comprises at least one infrared illuminator.

8. The ballistic vehicle-immobilization apparatus of claim 6, wherein the range-detection module comprises a laser symbol projector.

9. The ballistic vehicle-immobilization apparatus of claim 6, wherein the range-detector module is operable as a range finder.

10. The ballistic vehicle-immobilization apparatus of claim 6, wherein the range-detector module is operable as an aiming mechanism.

11. The ballistic vehicle-immobilization apparatus of claim 6, wherein the ballistic vehicle-immobilization apparatus is manually aimed by aligning the vehicle so that the laser light is on the object.

12. The ballistic vehicle-immobilization apparatus of claim 6, wherein the control computer is interoperably connected to at least one of the optical module, the range-detector module, and the firing mechanism.

13. The ballistic vehicle-immobilization apparatus of claim 6, wherein the ballistic vehicle-immobilization apparatus is operable in an assisted mode.

14. The ballistic vehicle-immobilization apparatus of claim 6, wherein the ballistic vehicle-immobilization apparatus is operable in an automatic mode.

15. The ballistic vehicle-immobilization apparatus of claim 1, wherein the optical module comprises an infrared camera.

16. The ballistic vehicle-immobilization apparatus of claim 1, wherein the optical module utilizes infrared radiation to illuminate the object.

17. The ballistic vehicle-immobilization apparatus of claim 1, further comprising a cover.

18. The ballistic vehicle-immobilization apparatus of claim 17, wherein the cover is adapted to protect against inadvertent firing of the firing mechanism.

19. The ballistic vehicle-immobilization apparatus of claim 17, wherein the cover prevents foreign objects from entering the firing mechanism.

20. The ballistic vehicle-immobilization apparatus of claim 17, wherein the cover is adapted to be rotated and positioned to cover substantially an entire front surface of the ballistic vehicle-immobilization apparatus.

21. The ballistic vehicle-immobilization apparatus of claim 17, wherein the cover is adapted to be slid into to cover substantially an entire front surface of the ballistic vehicle-immobilization apparatus.

22. The ballistic vehicle-immobilization apparatus of claim 17, wherein the cover is adapted to be rotated and positioned to cover the firing mechanism.

23. The ballistic vehicle-immobilization apparatus of claim 17, wherein the cover comprises at least one of plastic and metal.

24. The ballistic vehicle-immobilization apparatus of claim 17, wherein the cover is sacrificial.

25. The ballistic vehicle-immobilization apparatus of claim 1, wherein the ballistic vehicle-immobilization apparatus is operable in at least one of a manual mode, an assisted mode, and an automatic mode.

26. The ballistic vehicle-immobilization apparatus of claim 1, wherein the ballistic vehicle-immobilization apparatus is mounted on a front portion of the vehicle.

27. The ballistic vehicle-immobilization apparatus of claim 1, wherein the ballistic vehicle-immobilization apparatus is mounted adjacent a license plate on the driver's side of the vehicle.

28. The ballistic vehicle-immobilization apparatus of claim 1, wherein the ballistic vehicle-immobilization apparatus is adapted to fire frangible ammunition.

29. A vehicle-mounted ballistic vehicle-immobilization apparatus comprising:

an optical module adapted to provide visual feedback to a user to aim at an object;

a firing mechanism adapted to fire a projectile towards the object;

a control computer comprising:

a communication mechanism;

a processor; and a memory;

wherein the communication mechanism is operable to communicate information between the control computer and the ballistic vehicle-immobilization apparatus; and wherein, responsive to the speed of a vehicle to which the ballistic vehicle-immobilization apparatus is mounted exceeding a pre-determined threshold speed, the control computer communicates information to the firing mechanism that causes the ballistic vehicle-immobilization apparatus to disarm.

* * * * *

UNITED STATES PATENT AND TRADEMARK OFFICE

CERTIFICATE OF CORRECTION

PATENT NO. : 7,895,788 B1
APPLICATION NO. : 12/181571
DATED : March 1, 2011
INVENTOR(S) : Andrew Cilia et al.

It is certified that error appears in the above-identified patent and that said Letters Patent is hereby corrected as shown below:

Column 4, line 44

Replace "vehicle-mobilization system 100"
With -- vehicle-immobilization system 100 --

Column 6, Line 25

Replace "310 may be,"
With -- 310b may be, --

Column 7, Line 16

Replace "strikes the on which"
With -- strikes the rim on which --

Signed and Sealed this
Twenty-seventh Day of November, 2012

David J. Kappos

David J. Kappos
*Director of the United States Patent and Trademark Office*